US005909767A

United States Patent [19]

Batt

[11] Patent Number: 5,909,767

[45] Date of Patent: Jun. 8, 1999

[54] RECUPERATIVE CROSS FLOW PLATE-TYPE HEAT EXCHANGER

[75] Inventor: Paul J. Batt, Wellsville, N.Y.

[73] Assignee: ABB Air Preheater, Inc., Wellsville, N.Y.

[21] Appl. No.: 09/041,554

[22] Filed: Mar. 12, 1998

[51] Int. Cl.[6] ..... F28F 3/00

[52] U.S. Cl. ..... 165/166; 165/144

[58] Field of Search ..... 165/167, 166, 165/144, 81

[56] References Cited

U.S. PATENT DOCUMENTS

| | | | |
|---|---|---|---|
| 2,828,947 | 4/1958 | Hedbom | 165/166 |
| 3,363,681 | 1/1968 | Revilock et al. | 165/166 |
| 3,986,549 | 10/1976 | Huggins et al. | 165/166 X |
| 4,715,433 | 12/1987 | Schwarz et al. | 165/166 X |
| 5,303,771 | 4/1994 | Des Champs | 165/166 |

FOREIGN PATENT DOCUMENTS

| | | | |
|---|---|---|---|
| 1064137 | 5/1954 | France | 165/166 |
| 0051290 | 4/1980 | Japan | 165/166 |
| 0114094 | 5/1986 | Japan | 165/166 |
| 605346 | 7/1948 | United Kingdom | 165/166 |

*Primary Examiner*—Ira S. Lazarus
*Assistant Examiner*—Christopher Atkinson
*Attorney, Agent, or Firm*—Alix, Yale & Ristas, LLP

[57] ABSTRACT

Adjoining heat exchange modules of a recuperative cross flow plate-type heat exchanger are joined into a single unit by means of common plate spacer bars. Each common spacer bar extends between and into the adjacent modules. The prior art mid-module gaps are eliminated.

1 Claim, 4 Drawing Sheets

RECUPERATIVE CROSS FLOW PLATE-TYPE HEAT EXCHANGER

BACKGROUND OF THE INVENTION

The present invention relates to recuperative cross flow plate-type heat exchangers and particularly to the way in which multiple heat exchange modules are joined into a single pass unit.

Recuperative cross flow plate-type heat exchangers are comprised of a large number of parallel spaced plates with the flow of the hot material and the material to be heated flowing through alternate spaces between the plates. The flow of one material is in a first direction across the unit and the flow of the other material is in a second direction perpendicular to the first direction. This is referred to as cross flow.

Recuperative cross flow plate-type heat exchangers are typically used to transfer heat from one gas, such as hot flue gas, to another gas such as air. The design of these cross flow heat exchangers is usually limited by the standard dimensions of the plate material which is available. Therefore, it is typical that the larger units are formed from multiple modules. The prior art method of joining these modules into a single pass unit is by means of flanged connecting structures. These connecting structures create an open volume between the modules resulting in an increased overall size for a specific heat exchange capacity, in increased pressure drop and in increased fouling.

SUMMARY OF THE INVENTION

The present invention relates to recuperative cross flow plate heat exchangers in which modules are joined by common plate spacer bars eliminating the mid-module gaps.

DESCRIPTION OF THE PREFERRED EMBODIMENT

Figure 1:
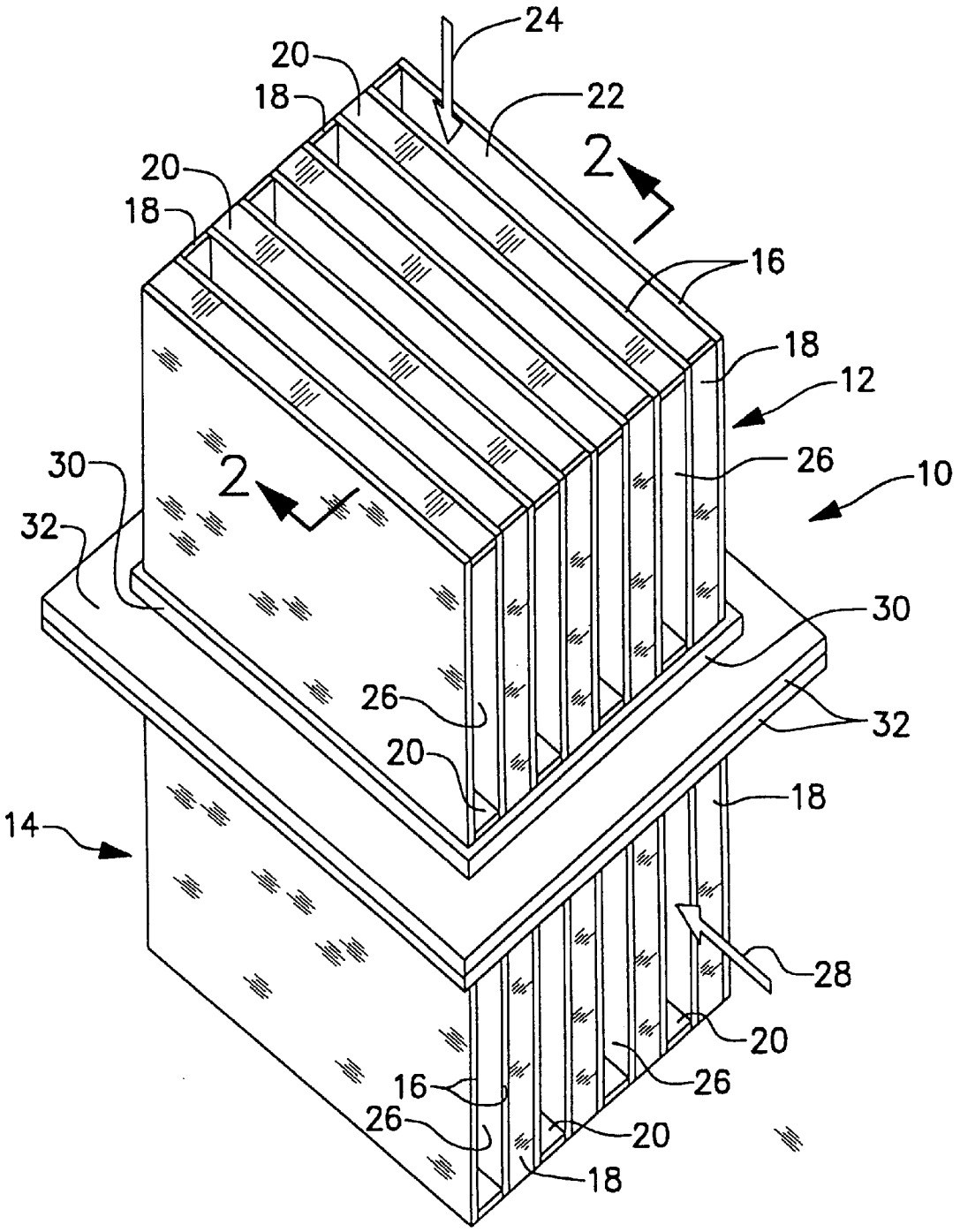
Fig. 1 (Prior Art)
FIG. 1 is an isometric view of a recuperative cross flow plate heat exchanger of the prior art including a mid-module connecting structure.
Figure 2:
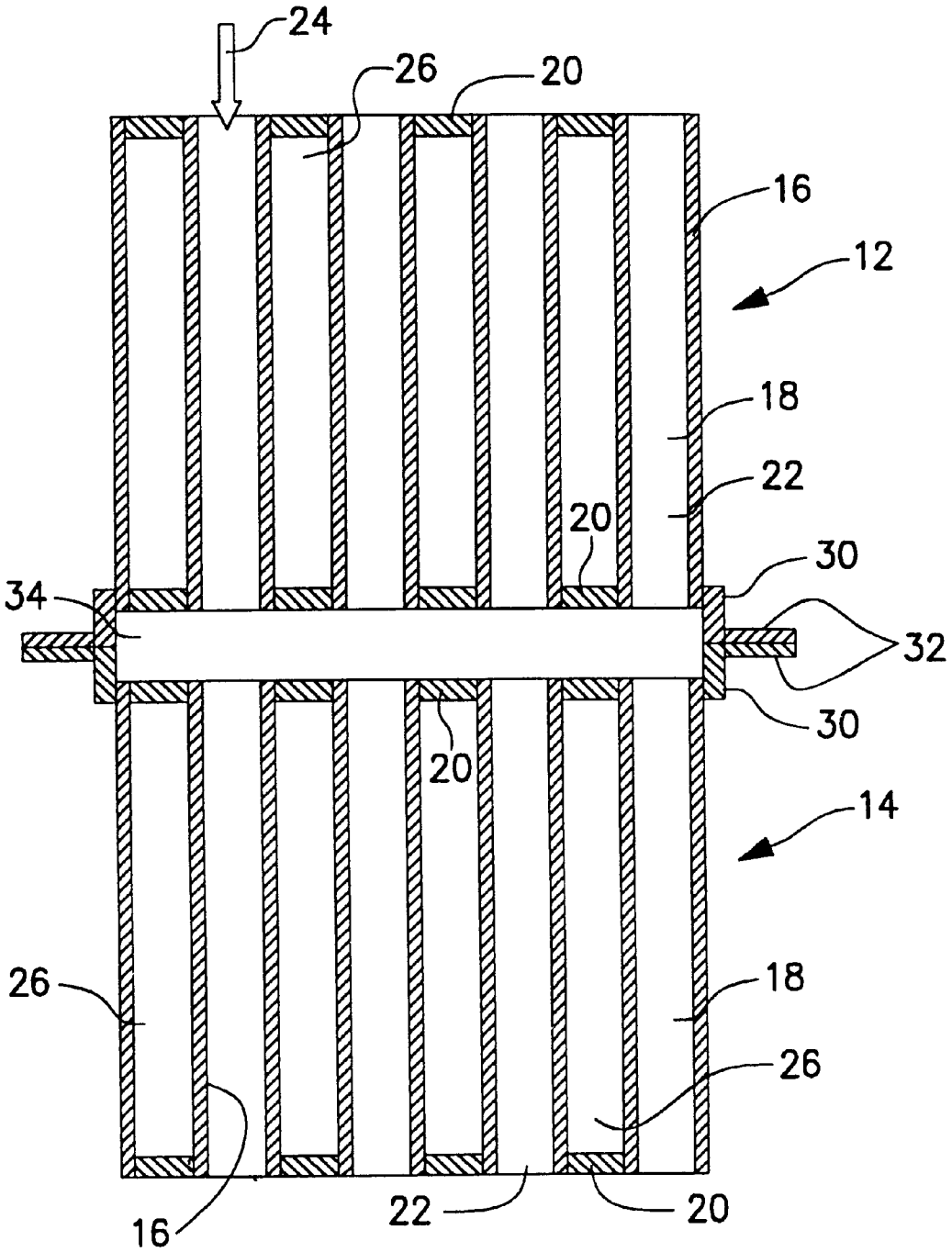
Fig. 2 (Prior Art)
FIG. 2 is a cross section view taken along the section 2—2 of FIG. 1.

A typical prior art recuperative cross flow heat exchanger 10 is shown in FIGS. 1 and 2 and comprises two modules 12 and 14 which are joined together to form an entire unit of the desired size. Each module comprises the plates 16 and the plate spacer bars 18 and 20. The plate spacer bars 18 are referred to as the hot bars or the plate spacer bars for the hot channels 22 which carry the heated gas such as flue gas. These hot bars 18 run from the top to the bottom on opposite sides of the modules. The flow of the flue gas is depicted by the arrow 24 in both FIGS. 1 and 2. The plate spacer bars 20 are referred to as the cold bars or the plate spacer bars for the cold channels 26 which carry the air or other gas to be heated. These cold bars 20 extend from one side to the other of each module. The flow of the air is depicted by the arrow 28 in FIG. 1.

As shown in these FIGS. 1 and 2, the modules 12 and 14 are joined together in the prior art by the peripheral connecting structure which comprises the peripheral member 30 on the adjacent ends of each module 12 and 14 and flange members 32 extending out from each peripheral member 30. The peripheral members 30 are suitably attached to their respective module 12 or 14 such as by welding. The flange members 32 attached to each peripheral member are attached to each other, such as by welding or bolting, to fasten the two modules together. As can be clearly seen in FIG. 2, this arrangement creates a gap or open volume 34 between the modules. The main function of the present invention is to avoid this gap or open volume.

Figure 3:
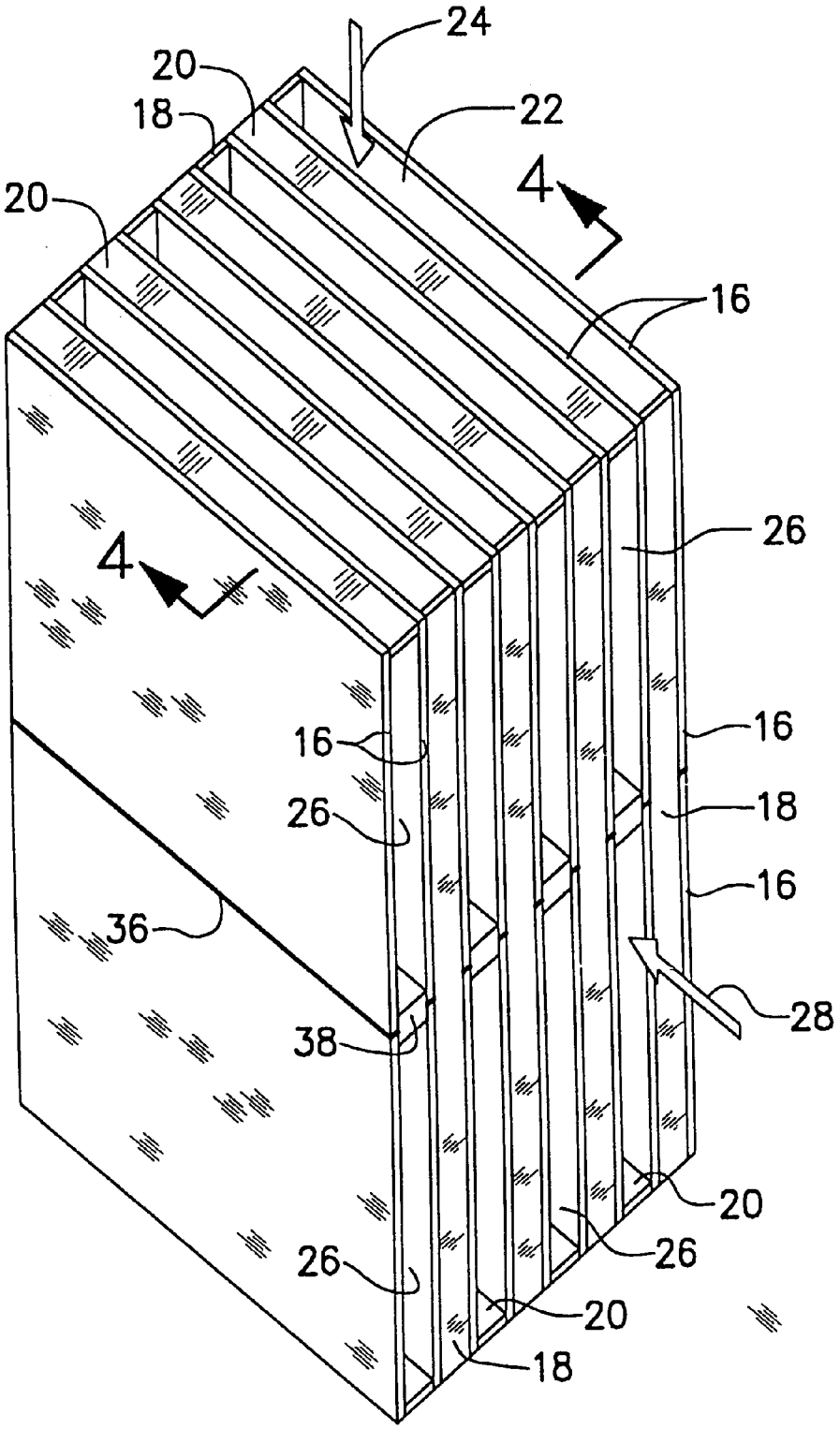
FIG. 3 is an isometric view of the recuperative cross flow plate heat exchanger according to the present invention which incorporates the common plate spacer bars for joining the modules.
Figure 4:
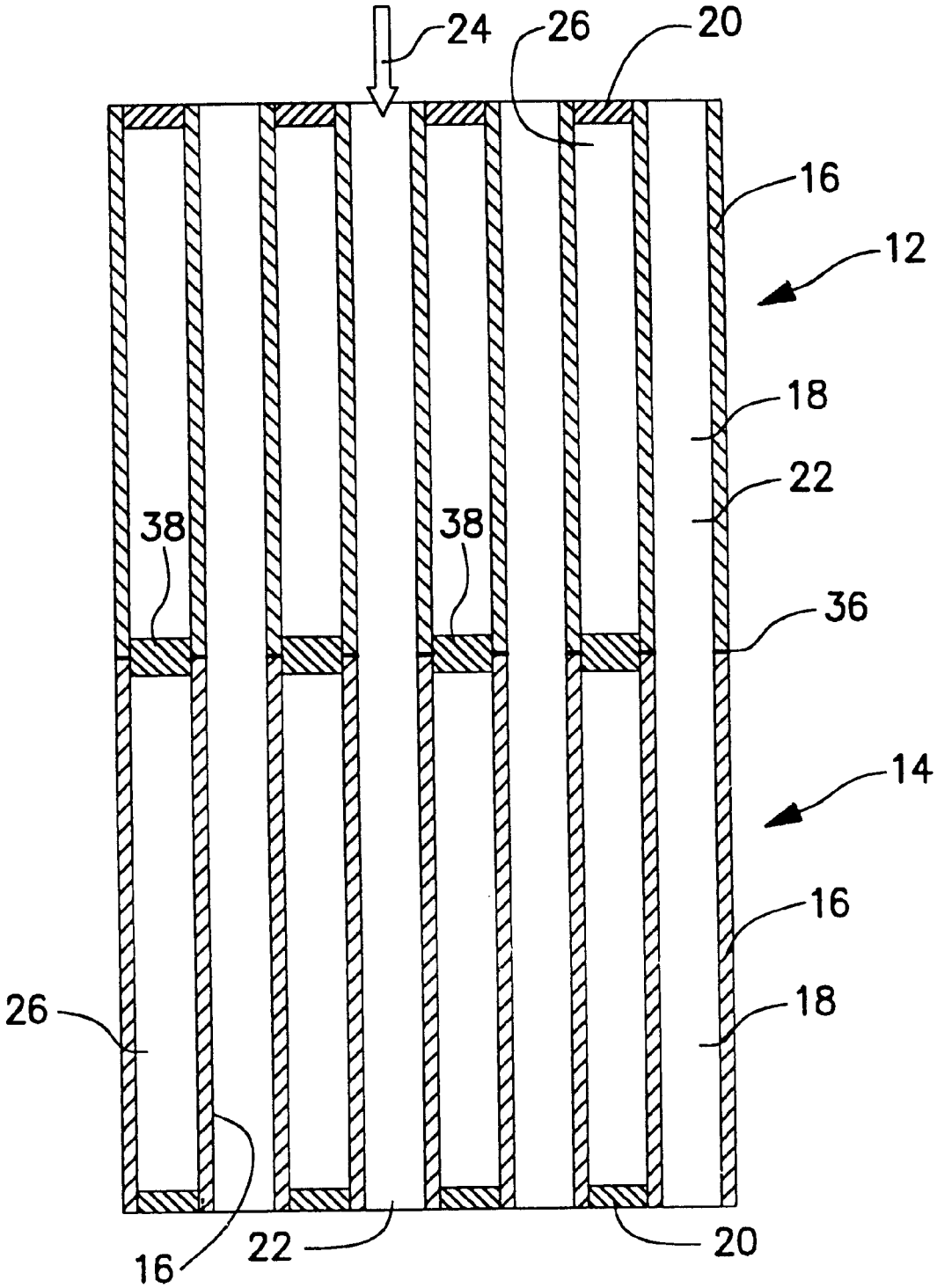
FIG. 4 is a cross section view taken along the section 4—4 of FIG. 3.

Referring now to FIGS. 3 and 4, a recuperative cross flow plate-type heat exchanger according to the present invention is shown which is similar to that shown in FIGS. 1 and 2 but which does not have the mid-module gap or open volume 34. As can be seen, the modules or sections 12 and 14 as well as the corresponding plates 16 now abut each other and are welded together at the juncture 36. The cold spacer bars 20 which were adjacent to the mid-module gap 34 of the prior art arrangement are now replaced with the enlarged cold spacer bar 38 which is common to each of the modules or sections 12 and 14. This cold spacer bar 38 is welded to the adjacent plates thereby joining the two modules 12 and 14 into a unitary heat exchanger. Also, the hot spacer bars 18 can now be full length equivalent to the height of the two modules together or they may be separate bars welded together at the juncture 36.

As can be seen, the present invention eliminates the open volume between the modules while still using plates of standard dimensions. There will now be less pressure drop for an equivalent heat exchange duty. Also, there is less chance of fouling because of the smooth flow passages. Further, the material and manufacturing costs will decrease. The invention still facilitates the use of dissimilar metals in the modules of a single core to accommodate excessive temperatures or prevent corrosion due to condensation in particular modules.

I claim:

1. A recuperative cross flow plate-type heat exchanger comprising first and second modules directly adjacent to each other, each said module comprising:

a. plurality of spaced apart parallel heat exchange plates, said spaced apart plates forming alternating first and second channels for a first gas and a second gas;

b. said plates forming said first channels being spaced apart by first spacer bars extending along two opposite edges of said plates thereby forming said first channels therebetween for said first gas;

c. said plates forming said second channels being spaced apart by second spacer bars extending along two opposite edges of said plates thereby forming said second channels therebetween for said second gas;

d. said first channels being perpendicular to said second channels and said first channels in said first modules aligning with said first channels in said second modules whereby said first gas flows serially through said first channels in said first and second modules; and wherein said second spacer bars at said edges between adjacent modules each comprise one common spacer bar extending between and into both said adjacent first and second modules.

* * * * *